United States Patent [19]

Geeson

[11] 3,937,112

[45] Feb. 10, 1976

[54] WEB FEEDING APPARATUS

[75] Inventor: Robert Ernest Geeson, Pinner, England

[73] Assignee: Metal Box Limited, Reading, England

[22] Filed: July 26, 1974

[21] Appl. No.: 492,232

[30] Foreign Application Priority Data

Aug. 8, 1973 United Kingdom ..... 37642/73

[52] U.S. Cl. ..... 83/57; 83/203; 83/209; 226/34; 226/117; 226/118; 242/75.42

[51] Int. Cl.[2] ..... B26D 5/00

[58] Field of Search ..... 226/117, 29, 34, 35, 24, 226/118, 97, 43; 242/75.42; 83/57, 203, 209

[56] References Cited

UNITED STATES PATENTS 3,608,804 9/1971 Swansen ..... 226/117 X 3,702,673 11/1972 Zernov ..... 226/117 X

*Primary Examiner*—Richard A. Schacher

*Attorney, Agent, or Firm*—Diller, Brown, Ramik & Wight

[57] ABSTRACT

In an apparatus for feeding a web, the web is continuously pulled from a reel by driven pairs of pinch rolls to create a loose storage loop from which the web is fed along a guide channel to a further pair of feed rolls, which when signalled passes material to a work station, under the influence of tensioning rolls acting on the web beyond the work station. Means are also provided for detecting and fullfilling the need for delivery of the web.

11 Claims, 1 Drawing Figure

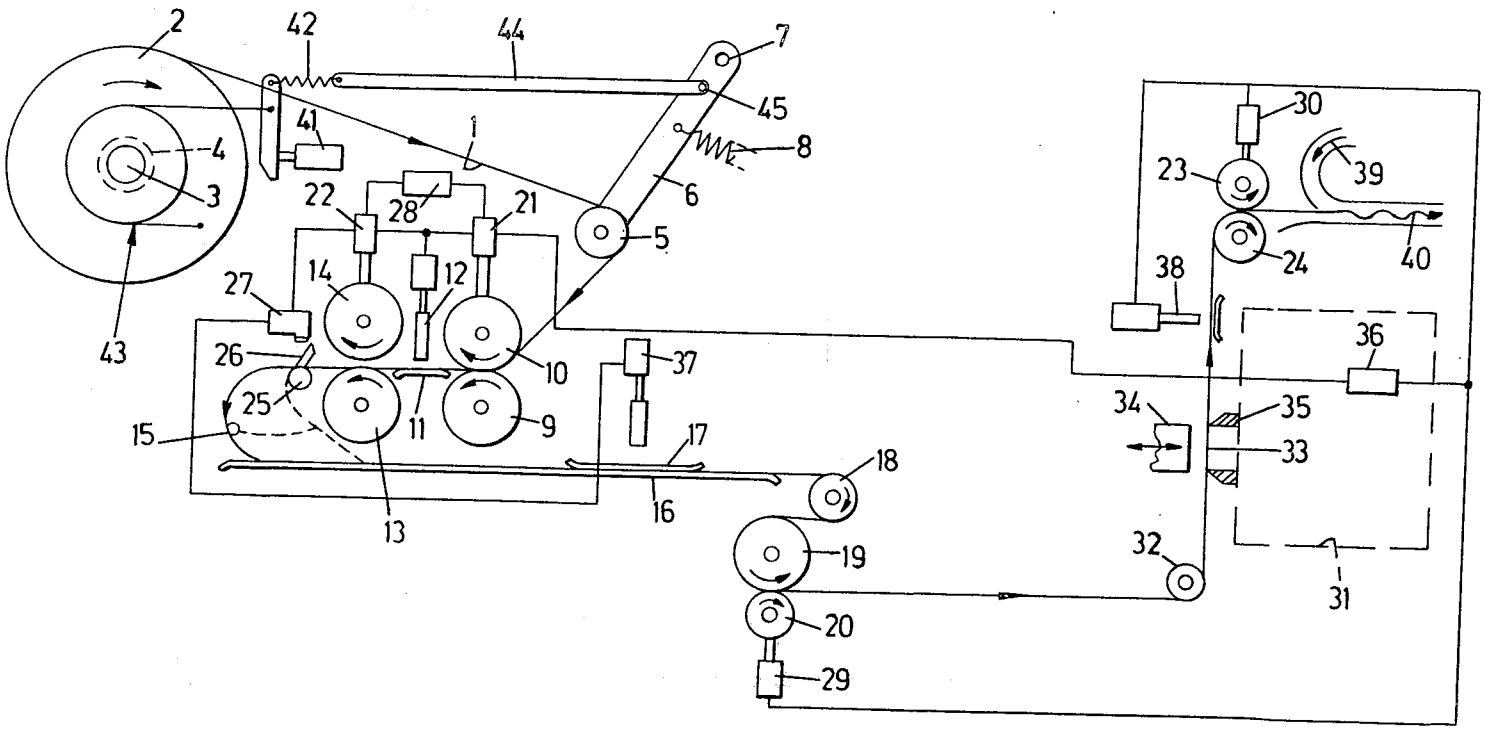
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45

WEB FEEDING APPARATUS

This invention relates to web feeding apparatus and it is an object of the invention to provide an apparatus capable of feeding a web intermittently from a continuously moving supply with accuracy and at a relatively high speed.

According to the invention a web feeding apparatus comprises a first feed roll, a second feed roll downstream of the first feed roll, said feed rolls each being rotatable at a predetermined constant peripheral velocity, a third feed roll downstream of the second feed roll, a fourth feed roll downstream of the third feed roll, said third and fourth feed rolls being synchronously intermittently rotated with accurate angular displacements of predetermined extent followed by simultaneous periods of dwell of predetermined duration, first, second, third, and fourth pressure rolls co-operable respectively with the first, second, third and fourth feed rolls, and pressure roll positioning means selectively operable to move the pressure rolls into and out of co-operative relation with the feed rolls, the arrangement being such that during normal web feeding operation of the apparatus one or other of the first and second pressure rolls co-operates with its respective feed roll to feed into a loop between the second and third feed rolls a portion of web the length of which approximates to that of the length of web fed by the third and fourth feed rolls in co-operation with their respective pressure rolls during one period of angular displacement of the third and fourth feed rolls.

The invention will now be described, by way of example, with reference to the accompanying diagrammatic drawing which illustrates a web feeding apparatus according to the invention as applied to a machine for blanking out diaphragms for application to the mouths of cans.

Referring to the drawing, a web 1, for example a web of paper, or of aluminium foil, is drawn from a reel 2 which is mounted on a freely rotatable spindle 3 on which it is gripped by expandable rubber rings 4. The web passes around a bridle roller 5 carried by an arm 6 pivoted at 7. A spring 8 causes the bridle roller 5 to apply tension to the web, the tension being maintained by resistance to rotation of the reel 2 exerted by a brake band 43 and by the web being gripped between a first feed roll 9 and a co-operating first pressure roll 10, or alternatively between a fixed guide 11 and a clamping device 12, or a second feed roll 13 and a co-operating second pressure roll 14, which are downstream of the feed roll 9.

After passing the second feed roll 13 the web is formed into a loop 15 and then passes between a guide channel 16 and pressure plate 17 which maintain a light tension in the web as it is drawn around a guide roll 18 by a third feed roll 19 and co-operating third pressure roll 20.

The feed rolls 9 and 13 are each rotatable at predetermined constant peripheral velocities such that when the web is being fed by the feed roll 9 and pressure roll 10 the length of web fed into the loop 15 is slightly less than that drawn from the loop by the third feel roll 19 and pressure roll 20, the third feed roll 19, which is downstream of the second feed roll 13, being rotated intermittently. When alternatively the second feed roll 13 and pressure roll 14 are feeding the web the length of web fed into the loop 15 is slightly greater than that drawn from the loop by the intermittent third feed roll 19 and pressure roll 20.

The pressure rolls 10 and 14, have pressure roll positioning means 21, 22 associated therewith and arranged to be selectively operable to move the pressure rolls into and out of co-operation with the feed rolls 9, 13. The arrangement is such that during normal web feeding operations the first pressure roll 10, the third pressure roll 20, and a fourth pressure roll 23, which co-operates with a fourth feed roll 24 also downstream of the first feed roll 9, are in co-operative engagement with their respective feed rolls 9, 19, and 24 and the length of the loop 15 is being gradually reduced until it contacts a trigger roll 25 which is located in the loop 15 and is carried by a lever 26 for co-operation with a microswitch 27 to give a signal to cause the second pressure roll 14 to move into co-operative engagement with the second feel roll 13, the first pressure roll 10 being simultaneously withdrawn from co-operative relation with the first feed roll 9 thus causing the length of the loop 20 to increase gradually for the whole of the time the signal is maintained, for a predetermined time interval controlled by a delay switch. The loop detector means may, alternatively, be photo-electric means arranged continuously to maintain the length of the loop between a high and a low limit. In the embodiment being described, it is assumed that the pressure roll positioning means 21, 22, together with pressure roll positioning means 29, 30 for rolls 20 and 23, are pneumatically operated devices but they may be otherwise operated devices, for example they may be hydraulically or electrically operated devices.

As stated above, the web feeding apparatus is assumed to be associated with a machine for applying diaphragms to the open ends of cans. This machine is of known construction and is indicated only by the broken lines 31. The web 1 on leaving the third feed roll 19 and pressure roll 20 passes round an idler roll 32, or alternatively over a fixed skid not shown, using pressurised air to form an air bearing for the web, and is moved vertically to the fourth feed roll 24 and co-operating pressure roll 23 because in the embodiment illustrated the blanking operation must be performed horizontally. During normal operation of the apparatus the synchronised intermittent motion of the third feed roll 20 and the fourth feed roll 24, which is also intermittently rotated, maintains a predetermined tension in the web as it passes through web treating means which are located between the third and fourth feed rolls 20 and 24 and which are operable to treat a portion 33 of the web extending between the feed rolls 20, 24 while the portion 33 is stationary. The third and fourth feed rolls 20 and 24 are synchronously intermittently rotated, as by a geneva or similar mechanism not shown, with accurate angular displacements of predetermined extents followed by simultaneous periods of dwell of predetermined duration.

The web treating means in the embodiment being described comprises a punch 34 and a die 35 arranged to punch out of the web a blank to form a diaphragm for application to a can, not shown. The machine 31 includes a can detector device 36, of any suitable kind, which is operable to determine when a can is in position to receive a diaphragm. In the absence of a can at the diaphragm applying position the detector device 36 effects operation of the pressure roll positioning means 21, 29 and 30 to cause the first pressure roll 10, the third pressure roll 20 and the fourth pressure roll 23 to be held out of co-operation with the feed rolls 9, 20 and 24 when the apparatus is running normally with the length of the loop 15 gradually reducing. Alternatively, if the second feed roll 13 and the second pressure roll 14 are operative so that the apparatus is running with the loop 15 gradually increasing, then in the absence of a can at the diaphragm applying position the detector device 36 effects operation of the pressure roll positioning means 22, 29, and 30 to hold the pressure rolls 14, 23, and 26 out of co-operative relation with the feed rolls 13, 20 and 24. The detector device 36 is also arranged to operate the clamping device 12 and clamping devices 37, 38 when the pressure rolls are moved out of co-operative relation with their respective feed rolls thereby to clamp the web at a position between the first and second feed rolls 9, 13 to maintain the tension against the bridle roll 5, between the loop 15 and the third feed roll 20, and between the web-treating means 33, 34 and the fourth feed roll 24. While the web is so clamped a light tension is maintained in the punched out portion 33 of the web by means of the clamp 38, or, if this is not used, by pressurised air indicated by arrow 39, thereby holding the web portion 33 accurately across the die 35 so that the punch 34 continues to pass through the last hole punched in the web until the next can arrives at the diaphragm applying position. During normal running of the apparatus the punched out portion of the web downstream from the feed roll 24 is removed by the pressurised air indicated by the arrow 40 for delivery into a container not shown.

It will be understood that the detector device 36 must be timed to operate the roll positioning means 29, 30 during the dwell period of the intermittently rotated feed rolls 20, 24, prior to the arrival of a can at the diaphragm applying position in order that the web is not fed forward if no can is present, and that when the roll positioning means 21 or 22 is thus operated simultaneously with the roll positioning means 29, 30 the length of the loop 15 will be reduced as a proportion of the cycle time of the constant velocity feed imparted by the feed roll 9 or feed roll 13 is lost, causing possible reduction of the length of the loop 15 below the low limit. To compensate for this condition the detector means 36 maintains a signal to the roll positioning means 22 to keep pressure roll 14 in co-operative relation with the feed roll 13, although pressure rolls 20 and 23 may be withdrawn from co-operative relation with the feed rolls 20, 24 until the loop length is restored to a position above the low limit.

To prevent the over-run of the reel 2 when the web feed is stopped from high speed movement thereof a pneumatic cylinder 41, or other suitable means, is arranged to over-ride the normal pressure applied by a spring 42 to a brake 43 on the reel spindle 3. When the force required to draw the web from the reel is of a light order, for example when the reel is of large diameter, the bridle roller 5 and its arm 6 will be relaxed away from the reel so that only a light force is applied to the spring 8, thus causing a link 44, pivoted at 45 to the arm 6, to apply tension to the spring 42, thereby exerting a braking force on the spindle 3. As the reel 2 reduces in diameter the web tension increases and draws the bridle roller 5 towards the reel so that the link 44 relaxes the tension on spring 42 and reduces the braking force on the reel spindle 3 so that tension in the web is maintained between acceptable limits.

To facilitate threading of the web 1 through the apparatus all pressure rolls 10, 14, 20, 23, and the clamps 12 and 37, and when applicable clamp 38, are arranged to be movable away from their associated feed rolls and guides, as appropriate, by manually operable pneumatic switches not shown.

The pressure rolls 10, 14, 20 and 23 are preferably rubber coated rolls.

During normal running of the apparatus the web 1 is moved intermittently between the feed rolls 20 and 24 which rotate one-half of a revolution in 180° of the cycle of the machine 31 to move the web portion 33 one pitch. The feed roll 9 also rotates at one-half a revolution per cycle of machine 33 but has a diameter which, for example, is 0.25 mm. less than that of the feed roll 20 so that the length of the loop 15 is gradually reduced, as described above, until the loop snatches at the trigger roll 25 and operates the microswitch 27, or alternatively exposes a photo-electric cell, not shown, to its light source. The feed roll 13 has a diameter which, for example, is 0.25 mm. greater than that of the feed roll 20 so that when the pressure roll 14 co-operates with the feed roll 13 the loop 15 gradually lengthens until the delay switch 28, or alternatively another photo-electric device not shown, causes the pressure roll 14 to be disengaged from co-operation with the feed roll 13 and the pressure roll 10 to be again moved into co-operation with the feed roll 9.

I claim:

1. Web feeding apparatus comprising a first feed roll, a second feed roll downstream of the first feed roll, said first and second feed rolls each being rotatable at a predetermined constant peripheral velocity, said first and second feed roll velocities being different, a third feed roll downstream of the second feed roll, a fourth feed roll downstream of the third feed roll, said third and fourth feed rolls being synchronously intermittently rotated with accurate angular displacements of predetermined extent followed by simultaneous periods of dwell of predetermined duration, first, second, third and fourth pressure rolls cooperative with said first, second, third and fourth feed rolls, and pressure roll positioning cooperable with each pressure roll and selectively operable to individually move the pressure rolls into and out of cooperative relation with the respective feed rolls, the arrangement being such that during normal web feeding operation of the apparatus one or other of the first and second pressure rolls cooperates with its respective feed roll to feed into a loop between the second and third feed rolls a portion of web the length of which approximates to that of the length of web fed by the third and fourth feed rolls in co-operation with their respective pressure rolls during one period of angular displacement of the third and fourth feed rolls.

2. Apparatus according to claim 1, wherein the peripheral velocity of said first feed roll is such that the first feed and pressure rolls when in feeding relation with the web feed into the loop a portion of web the length of which is slightly less than that drawn from the loop by the third feed roll, the peripheral velocity of said second feed roll is such that the second feed and pressure rolls when in feeding relation with the web feed into the loop a portion of web the length of which is slightly greater than that drawn from the loop by the third feed roll, and wherein detector means operable to gauge the length of the loop is operable on reduction of the length of the loop to a predetermined low level to render active the positioning means to render inoperative the first pressure roll and to render active the second pressure roll for a period of time determined by a time delay device.

3. Apparatus according to claim 2, wherein the diameter of the first feel roll is slightly less than that of the third feed roll and the diameter of the second feed roll is slightly greater than that of the third feed roll.

4. Apparatus according to claim 2, wherein the detector means comprises a microswitch operatively connected with pressure roll positioning means associated respectively with the first and second pressure rolls, trigger means located in the path of the loop for movement thereby on said reduction of the length of the loop, and a lever connecting the trigger means to the microswitch to effect operation thereof.

5. Apparatus according to claim 1, including guide channel and pressure plate means for applying a light tension to the web passing from the loop to the third feed and pressure rolls.

6. Apparatus according to claim 1, including a freely rotatable spindle arranged to be gripped by a reel of web material through expandable rubber rings, a friction brake co-operating with said spindle, a pivotally mounted arm carrying a bridle roller around which the web is drawn from the reel by the first and second feed and pressure rolls as appropriate, a spring acting on said arm to maintain tension in the web being drawn from the reel, and a lever arranged to control the brake and connected therewith through a spring lighter than that acting on said arm whereby movement of the arm under increasing tension relieves tension in the lighter spring to reduce frictional effort of the brake to achieve modulation of web tension between acceptable limits.

7. Apparatus according to claim 1, including web-treating means located between the third and fourth feed rolls, said web-treating means being operable to treat a portion of the web extending between the third and fourth feed rolls while the web portion is stationary.

8. Apparatus according to claim 7, wherein the web-treating means comprises a punch and a die arranged to punch a blank out of the web.

9. Apparatus according to claim 7, including normally inoperative clamping devices arranged respectively on receipt thereby of an operating signal to clamp the web between the second and third feed rolls and between the third and fourth feed rolls, and a signal initiating device operatively connected with the clamping devices to effect operation thereof and with pressure roll positioning means for each of the first, second, third, and fourth pressure rolls to move the third and fourth pressure rolls out of co-operation with the third and fourth feed rolls and also to move out of co-operation that one of the first and second pressure rolls which is co-operating with its feed roll on initiation of a signal by the signal initiating device.

10. Apparatus according to claim 8, wherein the blank is to form a diaphragm for application to the mouth of a can located adjacent to the die, and wherein the signal initiating device is a can detector device operable to determine when a can is in position to receive a diaphragm and is operable to initiate a clamping device and pressure roll positioning means operating signal in the absence of a can.

11. Apparatus according to claim 8, wherein the fourth feed and pressure rolls feed the punchedout web into a chute in which the web is held under a light lengthwise tension by pressurised air.

* * * * *